United States Patent [19]

Niinomi et al.

[11] 4,121,348

[45] Oct. 24, 1978

[54] TOUCH-RESPONSIVE CIRCUIT IN ELECTRONIC MUSICAL INSTRUMENT

[75] Inventors: Naoyuki Niinomi; Akiyoshi Oya, both of Hamamatsu, Japan

[73] Assignee: Nippon Gakki Seizo Kabushiki Kaisha, Hamamatsu, Japan

[21] Appl. No.: 751,323

[22] Filed: Dec. 16, 1976

[30] Foreign Application Priority Data

Dec. 29, 1975 [JP] Japan ..... 51/177203[U]
Dec. 29, 1975 [JP] Japan ..... 51/177205[U]

[51] Int. Cl.[2] ..... G10H 1/00; G10H 3/00; G10H 1/02

[52] U.S. Cl. ..... 84/1.01; 84/1.13; 84/1.26

[58] Field of Search ..... 84/1.01, 1.13, 1.1, 84/1.26, DIG. 7, 1.09, 1.27, DIG. 23

[56] References Cited

U.S. PATENT DOCUMENTS 3,626,074 12/1971 Hiyama ..... 84/1.01

*Primary Examiner*—Edith S. Jackmon
*Attorney, Agent, or Firm*—Cushman, Darby & Cushman

[57] ABSTRACT

In a touch-responsive circuit adapted for use in an electronic musical instrument provided with a keyboard, and comprising a key depression speed detector including a change-over switch, a capacitor for storing electric charge and a discharging resistor, and a controlling signal generating means including a gating transistor controlled by the key depression speed detector and another capacitor for storing electric charge through said transistor, a voltage-compensating element is connected in the key depression speed detector so as to compensate for the threshold voltage of the gating transistor thereby raising the minimum output voltage of the key depression speed detector and insuring the sound generation for the pianissimo performance.

10 Claims, 7 Drawing Figures

TOUCH-RESPONSIVE CIRCUIT IN ELECTRONIC MUSICAL INSTRUMENT

BACKGROUND OF THE INVENTION (a) Field of the Invention

This invention relates to tone level control in an electronic musical instrument, and more particularly, it pertains to touch-responsive control of the tone signal level in an electronic musical instrument.

(b) Description of the Prior Art

In an electronic musical instrument provided with a keyboard, the tone pitch is determined by the selection of the keys on the keyboard. Here, the tone level desirably is controlled by the speed of the depression of the desired key. Namely, it is desirable that, when a key is depressed strongly or at a high depression speed, a strong tone or a high level signal is generated, whereas when a key is depressed softly, a weak tone or a low level signal is generated. The correspondence between the key depression and the tone generation should desirably be held in the whole dynamic range.

In the conventional touch-responsive circuit desired for use in an electronic musical instrument, however, there exists a lower limit in the key depression for generating a tone. That is, in an extreme pianissimo performance, it may happen that no sound is generated from the instrument.

FIG. 1 shows an example of the conventional touch-responsive circuit designed for use in an electronic musical instrument provided with a keyboard. The circuit of FIG. 1 corresponds to one key and similar touch-responsive circuits are provided for the respective keys in the keyboard. In this figure, a tone generator TG generates a tone signal of a predetermined tone pitch corresponding to the key and a gate circuit GC (usually called keyer) controls, by a control signal, the signal level or the envelope of the tone signal to be delivered therefrom. The circuit for generating this control signal, i.e. the touch-responsive circuit, basically consists of a pair of charging and discharging circuits wherein the charging voltage for the pair's second circuit is controlled by the discharging voltage of the pair's first circuit and represents the speed of the key depression, i.e. the touch, and the voltage across a capacitor of the second circuit is fed to the gate circuit as the control signal.

A change-over key switch $SW_1$ is interlocked with the key of the keyboard and has: one stationary (normally closed) contact connected to a dc voltage source $E_1$, another stationary (normally open) contact connected to the base of a transistor $Q_1$, and a movable contact A connected to a parallel connection of a capacitor $C_1$ and a resistor $R_1$. The dc voltage source $E_1$, the change-over switch $SW_1$ and the parallel connection of the capacitor $C_1$ and the resistor $R_1$ connected to the movable contact of the switch $SW_1$ jointly constitute a key depression speed detector. More specifically, when the key is in its released state, the movable contact A is connected to the dc voltage source $E_1$ as shown in FIG. 1 and the capacitor $C_1$ is charged up to the source voltage $E_1$. When the key is depressed, the movable contact A is turned over to the base of the transistor $Q_1$. It should be understood that, during this part of operation, since the resistor $R_1$ forms a discharging circuit for the capacitor $C_1$, the voltage $V_{cl}$ across the capacitor $C_1$ decreases with time and hence the initial voltage applied to the base of the transistor $Q_1$ depends on how quickly the connection of the movable contact interlock with the key is changed over to the base of the transistor $Q_1$, i.e. the initial voltage depends on the key depression (movable contact travelling) speed. A base resistor $R_2$ is connected between the base of the transistor $Q_1$ and the ground. The collector-emitter circuit of the transistor $Q_1$ forms an electronic switch of a charging circuit for a capacitor $C_2$ from a voltage source terminal $V_{cc}$ through a resistor $R_4$. The resistor $R_4$ serves to determine the charging time constant for the capacitor $C_2$. As the resistor $R_4$ is of a very small resistance value, the capacitor $C_2$ is charged up rapidly. More particularly, when the movable contact A of the change-over switch $SW_1$ is connected to the base of the transistor $Q_1$, the voltage $V_{cl}$ across the capacitor $C_1$ is applied to the base of the transistor $Q_1$ and the transistor $Q_1$ is turned "on" to an extent corresponding to the base potential. Then, the capacitor $C_2$ is charged up to a voltage determined by the base potential of the transistor $Q_1$ which represents the key depression speed. The voltage $V_{cl}$ across the capacitor $C_1$ decreases due to the discharge through the resistors $R_1$ and $R_2$ (where $R_2 >> R_1$), and consequently the base potential of the transistor $Q_1$ falls to the ground level so that the transistor $Q_1$ is turned off. Thus the transistor $Q_1$ and the capacitor $C_2$ constitute a peak hold circuit of the voltage appearing at the movable contact A. Then, the charge stored in the capacitor $C_2$ begins to discharge through the resistors $R_3$ and $R_4$. Resistors $R_3$ and $R_4$ determine the discharging time constant for the capacitor $C_2$. Such a decaying voltage $V_{c2}$ is applied to the gate circuit GC for determining the envelope of the tone signal. Thus, the gate circuit GC allows the passage of a tone source signal having a level or an envelope corresponding to the key depression speed, i.e. the touch.

In such a touch-responsive circuit, however, it should be understood that, when a key is depressed very slowly, the charge stored in the capacitor $C_1$ may be discharged out substantially during the period that the movable contact A travels from the dc voltage source $E_1$ to the base of the transistor $Q_1$. Namely, when the key is depressed and the movable contact A is disconnected from the dc voltage source $E_1$, the voltage $V_{cl}$ across the capacitor $C_1$ begins to decrease as shown by the broken curve in FIG. 3. In FIG. 3, the ordinate represents the voltage $V_{cl}$ across the capacitor $C_1$ (potential at the movable contact) and the abscissa represents "time" from the disconnection of the movable contact A off the dc voltage source $E_1$ (i.e. key depression). Here, since the resistance of the base circuit of the transistor $Q_1$ may be substantially large as compared with the resistance $R_1$, the connection of the movable contact A to the base of the transistor may not alter the curve substantially. When the potential at the movable contact decreases below some level before the movable contact somes into contact with the base of the transistor $Q_1$, the transistor $Q_1$ does not become sufficiently conductive to charge the capacitor $C_2$ to a level sufficiently high to open the gate circuit GC. Then, no tone signal is derived from the tone generator TG through the gate circuit GC even when the key is depressed.

More particularly, in the circuit of FIG. 1, let us now assume that the threshold base-to-emitter voltage of the transistor is $V_{th}$ (>0), the voltage $V_{cl}$ at the movable contact A of the switch $SW_1$ should not decrease below the threshold voltage $V_{th}$ to insure tone production. Since, however, the voltage $V_{cl}$ is arranged to drop from $E_1$ toward zero through the resistor $R_1$, treating the threshold voltage $V_{th}$ only as an arbitrary transient (passing point) voltage, a pianissimo performance may not generate a controlling voltage above the threshold voltage, and hence any sound will not be produced.

SUMMARY OF THE INVENTION

An object of the present invention, therefore, is to provide a touch-responsive circuit for controlling a tone signal level by the touch of a key operation, adapted for use in an electronic musical instrument provided with a keyboard and being capable of insuring the weakest tone generation corresponding to the pianissimo performance.

Another object of the present invention is to provide a touch-responsive circuit for controlling a tone signal level by the depression of a key operation on the keyboard, adapted for use in an electronic musical instrument provided with a keyboard and comprising a transistor having a threshold voltage and a discharging circuit connected to the transistor and including a voltage-compensating element for generating a voltage at least equal to the threshold voltage of the transistor.

According to an aspect of the present invention, there is provided a touch-responsive circuit adapted for use in an electronic musical instrument provided with a keyboard, comprising: a voltage-controlled circuit means having a threshold voltage for generating an output signal, and a key depression speed detector for generating a voltage signal having a level corresponding to the depression speed of a key in the keyboard and at least equal to the threshold voltage for controlling the voltage-controlled circuit means.

According to the above aspect, the controlling voltage signal never decreases below a certain level, and hence the tone generation is assured even for the pianissimo performance.

DESCRIPTION OF THE PREFERRED EMBODIMENTS

Figure 1:
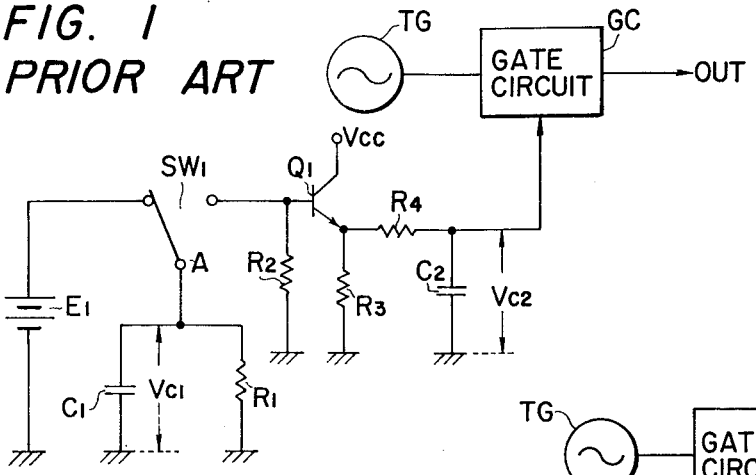
FIG. 1 PRIOR ART
FIG. 1 is a circuit diagram of an example of the conventional touch-responsive circuit for use in an electronic musical instrument.

The conventional touch-responsive circuit as shown in FIG. 1 has a drawback that a pianissimo performance may not generate any sound. This is because the output level of the key depression speed detector can drop below a certain threshold value for generating a sound.

This can be prevented by compensating for the threshold voltage by some means or other. One of the most appropriate method is to insert an compensating element in the key depression speed detector for insuring the threshold voltage. Generally, a transistor is used as the gating element for charging a capacitor, and the output of a key depression speed detector controls this transistor as shown in FIG. 1. The voltage drop between the base and the emitter in the transistor constitutes a threshold voltage for generating tone. For compensating for this threshold voltage, the use of a similar pn-junction (i.e. diode) is very effective.

Figure 2:
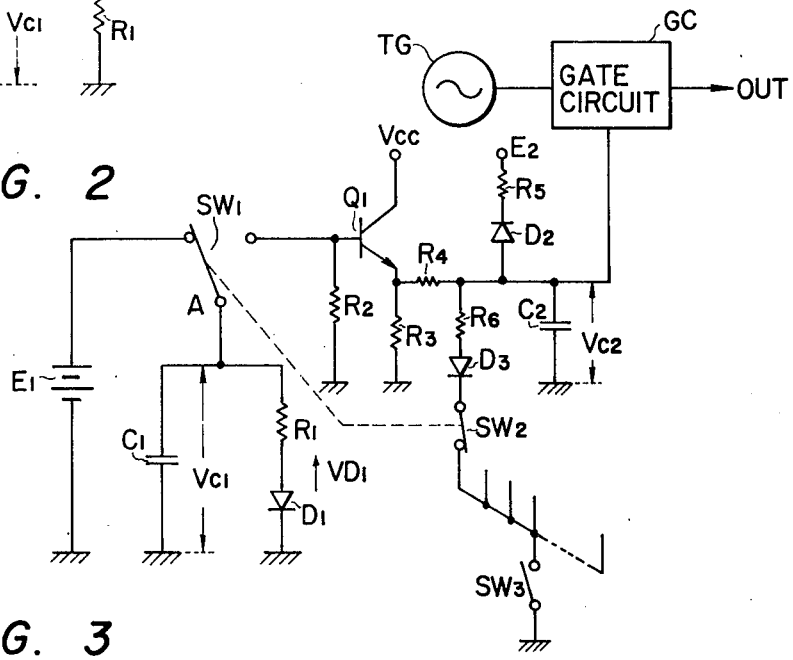
FIG. 2 is a circuit diagram representing an example of the touch-responsive circuit for use in an electronic musical instrument according to the present invention.

An example of use of a diode for compensating for the threshold voltage of a transistor is shown in FIG. 2. Throughout the figures, similar reference letters denote similar parts.

Figure 3:
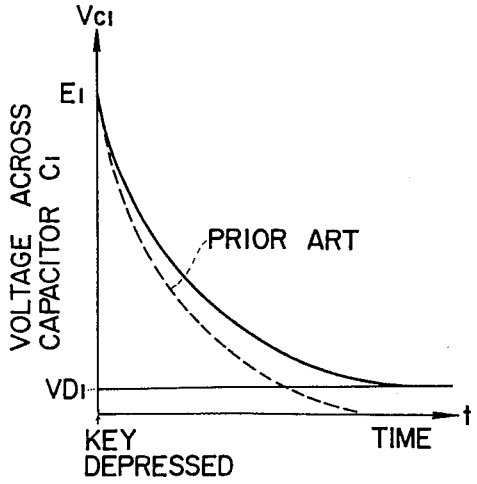
FIG. 3 is a chart of the capacitor voltage vs. time in the key depression speed detecting circuit for the comparison between the conventional and the present touch-responsive circuits.

In FIG. 2, a key depression speed detector includes a series connection of a resistor $R_1$ and a diode $D_1$ in place of the resistor $R_1$ shown in FIG. 1. That is, the discharging circuit for a capacitor $C_1$ is formed of the resistor $R_1$ and the diode $D_1$ which provides a certain forward voltage. Thus, the voltage $V_{c1}$ across the capacitor $C_1$ decreases toward that voltage as shown by the solid curve in FIG. 3. In FIG. 3, letter $V_{D1}$ represents the minimum forward voltage drop $V_{D1}$ in the diode $D_1$ which is substantially equal to the threshold value of the transistor $Q_1$.

When the key is depressed, the interlocked contact A of the switch $SW_1$ is disconnected from the dc voltage source $E_1$, and the voltage $V_{c1}$ across the capacitor $C_1$ begins to decrease. Here, even if the key is depressed very slowly, i.e. when it takes a considerable time for the contact A to swing over from the voltage source $E_1$ to the base of the transistor $Q_1$, the voltage $V_{c1}$ will never decrease below $V_{D1}$. Therefore, when the contact A comes into contact with the base of the transistor $Q_1$, it supplies a voltage at least equal to the threshold voltage of the transistor $Q_1$, and the transistor $Q_1$ becomes conductive to a corresponding degree.

Thus, the transistor $Q_1$ for charging a capacitor $C_2$ from a dc voltage source $V_{CC}$ through a resistor $R_4$ is controlled in a touch-responsive manner in the full range of the key depression. The voltage across the capacitor $C_2$ is applied to the gate circuit GC for controlling the passage of the tone signal from the tone generator TG. An emitter resistor $R_3$ for the transistor $Q_1$ also forms a discharging path for the capacitor $C_2$ jointly with the resistor $R_4$. A series connection of a resistor $R_5$ and a diode $D_2$ is connected between another dc voltage source $E_2$ and the capacitor $C_2$ to form another discharging path for the capacitor $C_2$. The voltage of $E_2$ is lower than that of $V_{CC}$. A series connection of a resistor $R_6$, a diode $D_3$ and switches $SW_2$ and $SW_3$ is connected between the capacitor $C_2$ and the ground to form still another discharging path for the capacitor $C_2$. The diodes $D_2$ and $D_3$ are used for preventing the reverse current flow. The switch $SW_2$ is interlocked with the key similar to the switch $SW_1$ and is closed when this key is released, when the switch $SW_1$ is connected to the voltage source $E_1$. The switch $SW_3$ is normally closed and opened by the depression of a damper (or sustain) pedal. The resistor $R_3$ has a relatively large resistance as compared with those of the resistors $R_5$ and $R_6$. The resistor $R_5$ has a relatively small resistance value to expedite the discharge.

Figure 4:
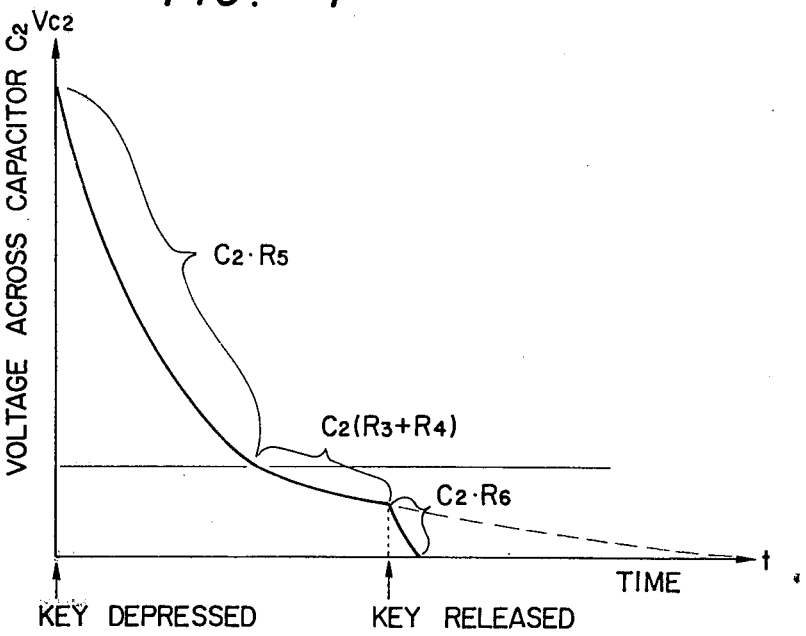
FIG. 4 is a chart of the output voltage shapes of the touch-responsive circuit shown in FIG. 2.

Next, the operation of the circuit discussed above will be described. When the key is depressed, a dc voltage dependent upon the key depression is applied to the base of the transistor $Q_1$ and the capacitor $C_2$ is charged up rapidly to that dc voltage through the transistor $Q_1$ and the resistor $R_4$ as the resistor $R_4$ has a very small resistance. The charged-up voltage across the capacitor $C_2$ opens the gate circuit GC to an extent determined by that voltage. At this point, the switch $SW_2$ is in the open state. Then, the capacitor $C_2$ discharges mainly through the diode $D_2$ and the resistor $R_5$ with a time constant of $C_2 \cdot R_5$. Here, since the resistance of the path including the resistors $R_3$ and $R_4$ is large, the effect of this path can virtually be neglected in this initial decaying period. Since the discharging path including the resistor $R_5$ and the diode $D_2$ is connected to the dc potential $E_2$, it is virtually cut off when the voltage $V_{c2}$ across the capacitor $C_2$ approaches the potential $E_2$. Then, the discharging path including the resistors $R_3$ and $R_4$ plays the main role with a time constant $C_2(R_3+R_4)$. When the damper switch $SW_3$ is kept closed (i.e. the damper pedal is not depressed) and the switch $SW_2$ returns back to the closed state, the discharging path through the resistor $R_6$, the diode $D_3$ and the switches $SW_2$ and $SW_3$ is formed to expedite the discharge of the capacitor $C_2$. Then, the voltage $V_{c2}$ across the capacitor $C_2$ decreases rapidly after the key release as shown by the solid curve in FIG. 4. If the damper pedal is released (i.e. the switch $SW_3$ is closed) after the release of the key, it will be apparent that the accelerated damping effect occurs thereafter.

More particularly, while the key is being depressed (the switch $SW_2$ is open), the discharging path through the resistor $R_5$ and the diode $D_2$ plays the main role in the initial stage and the discharging path through the resistors $R_3$ and $R_4$ acts in the succeeding stage. Since the resistance $R_3$ is large, the decaying in the succeeding stage is slow. When the key is released with the damper pedal being not depressed, the discharging path through the resistor $R_6$ and the diode $D_3$ becomes dominant to swiftly discharge the capacitor $C_2$. On the other hand, when the key is released with the damper pedal being depressed, the above-mentioned slow decay continues, as the $R_6$–$D_3$ discharging path is not established.

Figure 5:
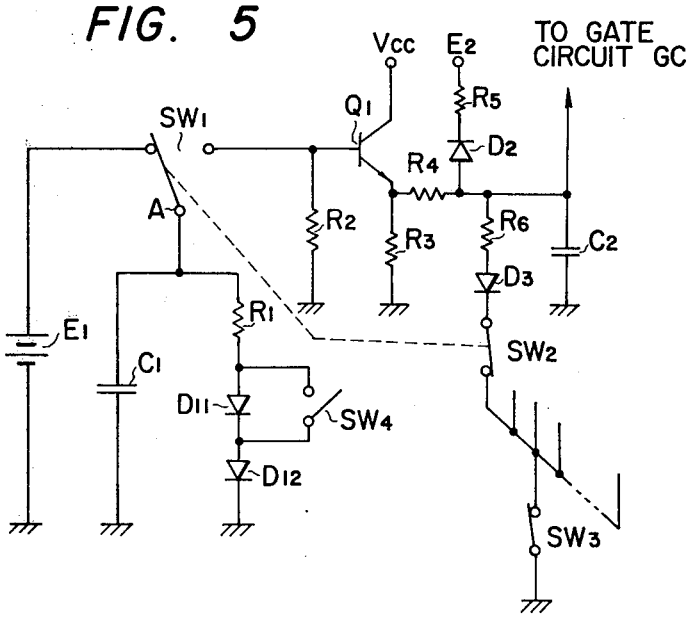
FIG. 5 is a circuit diagram of another example of the touch-responsive circuit according to the present invention.

A modification of the circuit of FIG. 2 is shown in FIG. 5, in which two diodes $D_{11}$ and $D_{12}$ are connected in series to the resistor $R_1$, and a short-circuiting switch $SW_4$ is connected in parallel to one $D_{11}$ of the two diodes in place of the single diode $D_1$ in the circuit of FIG. 2. When the switch $SW_4$ is closed, the circuit in this example is similar to the circuit of FIG. 2. When the switch $SW_4$ is open, however, the minimum level of the base bias voltage for the transistor $Q_1$ increases. Hence, the addition of a diode $D_{11}$ and a short-circuit switch $SW_4$ enables the choice of the minimum output level. It will be apparent that the number of the additional diodes is not limited to one.

In the circuit of FIGS. 2 and 5, the transistors $Q_1$ and the voltage source $V_{CC}$ may be replaced by a diode for simplifying the circuit. In such a case, the capacitor $C_2$ is charged by the discharging current from the other capacitor $C_1$.

Figure 6:
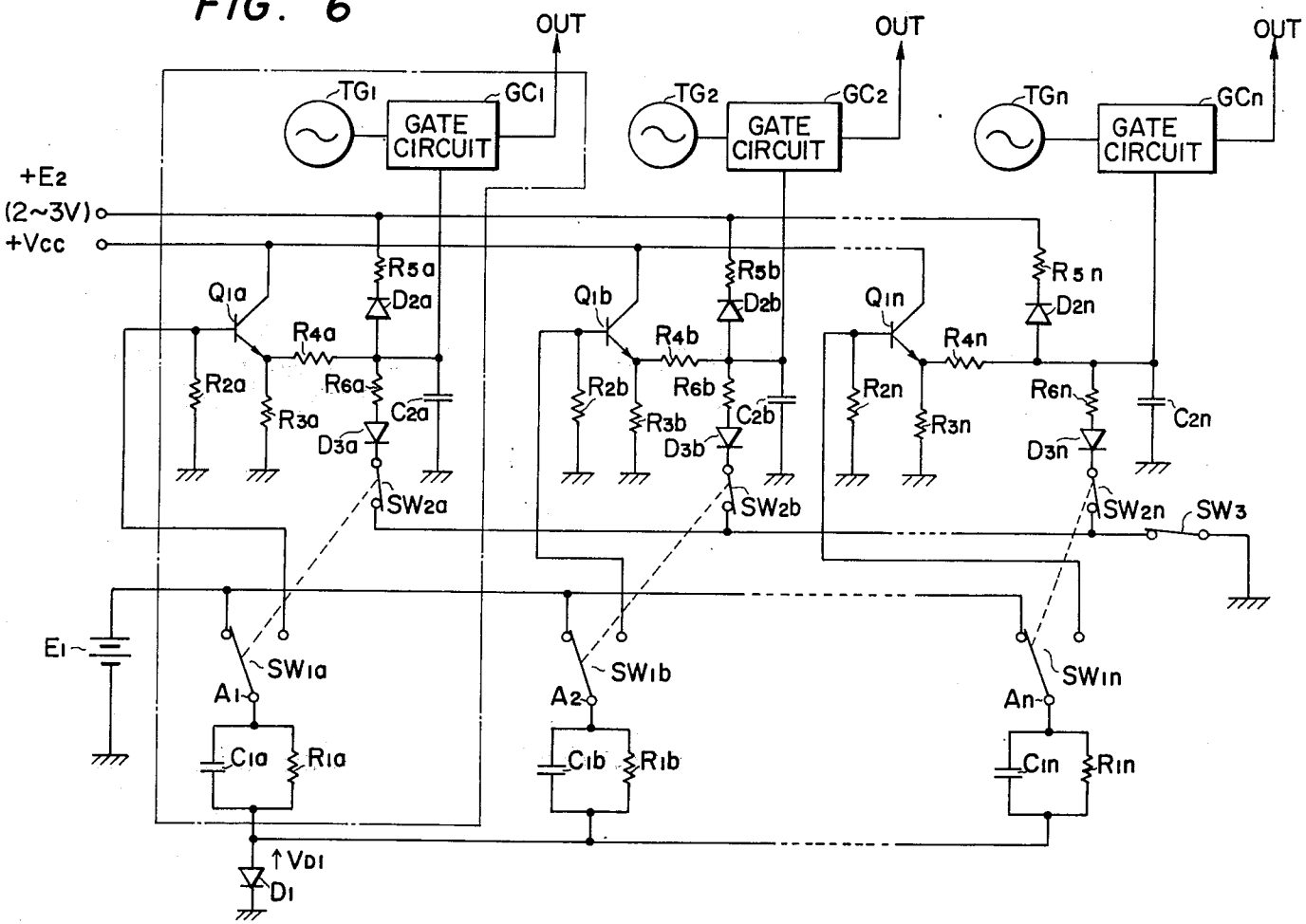
FIG. 6 is a circuit diagram of still another example of the touch-responsive circuit according to the present invention.

FIG. 6 shows another example of the touch-responsive circuit, in which the number of diodes in the key depression speed detector for all the keys is reduced to one. The touch-responsive circuitry for each key is shown by the portion sorrounded by a chain line. The key depression speed detector is similar to the conventional structure shown in FIG. 1. The only difference, however, is found in the arrangement that the parallel connection of the capacitor $C_{1a}$ and the resistor $R_{1a}$ is connected to the ground potential not directly but through a common diode $D_1$. Comparing this example with that of FIG. 2, this example has the advantage that the number of the diodes employed in the circuitry can be greatly reduced. Here, it should be noted that when a key is depressed and the connection of the corresponding switch e.g. $SW_{1a}$ changed over to the base of the corresponding transistor $Q_{1a}$, the diode $D_1$ remains to be still connected to the dc potential source $E_1$ through the resistor $R_{1b}$ to $R_{1n}$ in the other key depression speed detectors, and thus generates a voltage drop $V_{D1}$ thereacross.

Figure 7:
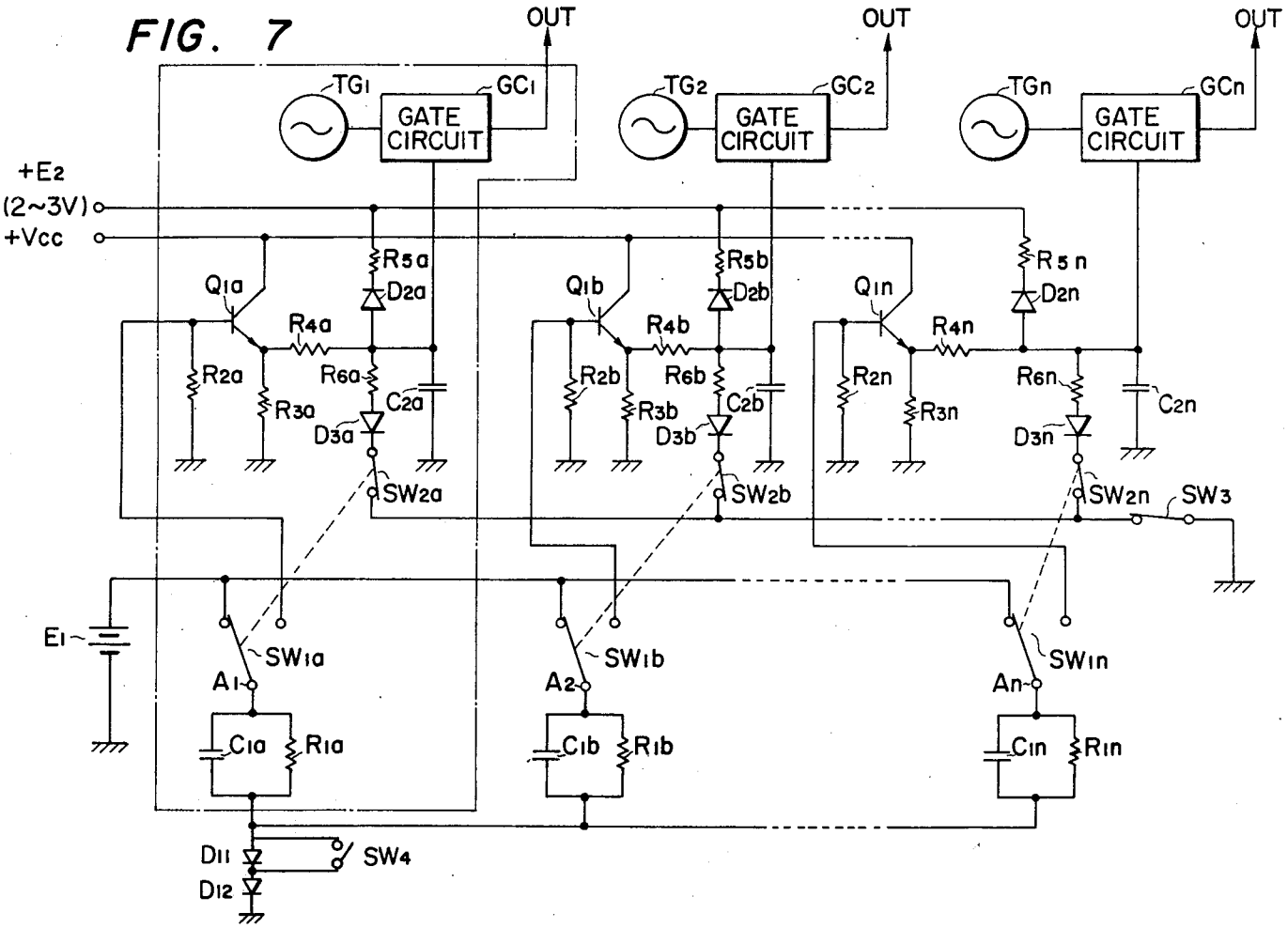
FIG. 7 is a circuit diagram of yet another example of the touch-responsive circuit according to the present invention.

FIG. 7 shows an alternation of the example of FIG. 6, in which the selection of the minimum level is enabled similar to the circuit of FIG. 5 by the addition of a diode (or diodes) and a short-circuiting switch (or switches). The operation of this circuit will be apparent from the description of the circuits of FIGS. 5 and 6.

It will be seen that the diode $D_1$ in the circuits of FIGS. 6 and 7 may be replaced by a resistor.

We claim:

1. A touch-responsive circuit adapted for use in an electronic musical instrument provided with a keyboard comprising:
   - a voltage-controlled circuit means having a threshold voltage for generating an output signal; and
   - a key depression speed detector for generating a voltage signal having a level corresponding to the depression speed of a key in the keyboard,
   - said key depression speed detector including a first constant dc voltage source, a first capacitor for storing an electric charge from said first dc voltage source and a discharging circuit means for discharging said first capacitor including a voltage-compensating means comprising a first semiconductor element for generating a voltage drop thereacross at least equal to said threshold voltage.

2. A touch-responsive circuit according to claim 1 in which:
   - said voltage-controlled circuit means includes a second semiconductor element having said threshold voltage for allowing a current flow.

3. A touch-responsive circuit for use in an electronic musical instrument provided with a keyboard having a multiplicity of keys, comprising:
   - a common voltage-compensating means; and
   - a multiplicity of circuit units, each being designated to one key, each of said circuit units comprising a voltage-controlled circuit means having a threshold voltage for generating an output signal, and a key depression speed detector for generating a voltage signal of a level representing the depression speed of the designated key,
   - each of said key depression speed detectors including a parallel connection of a capacitor and a resistor connected to a reference potential through said common voltage-compensating means,
   - said common voltage-compensating means generating a voltage at least equal to said threshold voltage and being added to the voltage signal of said key depression speed detector to provide a voltage signal for controlling said voltage-controlled circuit means.

4. A touch-responsive circuit according to claim 2, in which:
   - said first and second semiconductor elements are diodes.

5. A touch-responsive circuit according to claim 1, in which:

said discharging circuit means further includes a parallel connection of a diode and a short-circuiting switch connected in series to said first-semiconductor element.

6. A touch-responsive circuit according to claim 2, in which:

said voltage-controlled circuit means further includes a second capacitor to be charged through said second semiconductor element, a second dc voltage source, a first discharging path consisting of resistive means and connected between said second capacitor and the ground, and a second discharging path including a diode for preventing the reverse current-flow and connected between said second capacitor and said second dc voltage source.

7. A touch-responsive circuit according to claim 6, in which:

said voltage-controlled circuit means further includes a third discharging path including a damping switch for expediting the discharge of said second capacitor when the damping switch is closed.

8. A touch-responsive circuit according to claim 7, in which:

said third discharging path includes another switch interlocked with a corresponding key in the keyboard and being closed when the key is in the released position so that an enhancement of the discharge of said second capacitor takes place only when the key has returned to the released position.

9. A touch-responsive circuit according to claim 3, in which:

said common voltage-compensating means is a semiconductor element.

10. A touch-responsive circuit according to claim 2, in which:

said first and second semiconductor elements are a diode and a transistor, respectively.

* * * * *